US008915621B2

(12) United States Patent
Alverson et al.

(10) Patent No.: US 8,915,621 B2
(45) Date of Patent: Dec. 23, 2014

(54) LAMP STRUCTURE WITH STACKED TRANSPARENT BOARDS

(71) Applicants: Karl F. Alverson, Newton, NJ (US); Wei-Hao Du, Taipei (TW)

(72) Inventors: Karl F. Alverson, Newton, NJ (US); Wei-Hao Du, Taipei (TW)

( * ) Notice: Subject to any disclaimer, the term of this patent is extended or adjusted under 35 U.S.C. 154(b) by 0 days.

(21) Appl. No.: 13/896,187

(22) Filed: May 16, 2013

(65) Prior Publication Data

US 2013/0308321 A1 Nov. 21, 2013

Related U.S. Application Data

(60) Provisional application No. 61/648,454, filed on May 17, 2012.

(51) Int. Cl.
*F21V 5/02* (2006.01)
*F21V 1/16* (2006.01)

(52) U.S. Cl.
CPC ..... *F21V 1/16* (2013.01)
USPC ..... 362/311.14; 362/309; 362/565

(58) Field of Classification Search
CPC ..... F21V 1/00; F21V 1/16; F21V 1/20; F21V 1/22; F21V 2008/006; F21V 5/007; F21V 5/008; F21V 5/06
USPC ..... 362/240, 308–310, 311.01–311.05, 362/311.13, 311.14, 565, 577, 605–607, 362/610–613; 385/129–131
See application file for complete search history.

(56) References Cited

U.S. PATENT DOCUMENTS 4,214,391 A * 7/1980 Angst ..... 40/451
6,856,753 B2 * 2/2005 Biscardi et al. ..... 385/147

* cited by examiner

*Primary Examiner* — Hargobind S Sawhney
(74) *Attorney, Agent, or Firm* — Juan Carlos A. Marquez; Bacon & Thomas PLLC

(57) ABSTRACT

The present invention discloses a lamp structure with stacked light transparent boards. The lamp structure includes a lamp base, a light source module, plural transparent boards, and an electrical wire module. The light source module is placed inside the lamp base and is connected to an outside power supply by the electrical wire module, the transparent boards are stacked on the lamp base, and each of the transparent boards has a central hole, the central hole can be of different size for different transparent boards. The central holes of the transparent boards together form the designed light shape of the lamp structure. Lamp designs and productions by using the lamp structure of the present invention is easier and cheaper and full of plenty diversities. The repairing cost is low, since only replacement of the damaged portion of the lamp structure is required, but not throwing away the whole lamp.

12 Claims, 10 Drawing Sheets

LAMP STRUCTURE WITH STACKED TRANSPARENT BOARDS

BACKGROUND OF THE INVENTION

1. Technical Field

The present invention relates to lamp structures, and more particularly, to a lamp structure with a plurality of stacked transparent boards.

2. Description of Related Art

When it comes to a wide variety of lamp manufacturing technologies nowadays, acrylate is in wide use and has great appeal to consumers because of its resistance to collision, transparency, and color variability. However, conventional lamp manufacturing methods mostly entail shaping lamps in terms of the appearance thereof before the lamps are delivered and assembled, thereby resulting in drawbacks as follows: overly large required space of delivery, increased susceptibility to collision, the need to follow specific assembly steps before starting to use, and, most importantly, the impossibility to change the shape of the finished products thus assembled.

Accordingly, it is imperative to provide a lamp and a manufacturing method thereof which have advantages, namely ease of delivery, resistance to collision, and variable shape to not only meet manufacturers' need for wide application, but also appeal to consumers.

SUMMARY OF THE INVENTION

The present invention provides a lamp structure with stacked transparent boards, characterized in that: transparent boards each having a central hole are separably and vertically stacked on a lamp base; with the central holes being of different size, light emitted from a light source module passes through the transparent boards; and, due to the arrangement of the transparent boards according to the size of the central holes of the transparent boards, the central holes together form the designed light shape of the lamp structure. A light-emitting diode (LED), which is energy-efficient, scorch-proof, and long in service life, functions as the light source of the light source module to thereby enhance the ease of use of the lamp structure.

The present invention provides a lamp structure with stacked transparent boards, comprising: a lamp base having a hollow core and comprising: a bottom plate; a top plate corresponding in position to the bottom plate and having a centrally-disposed light-emitting hole; and a side plate extending from an edge of the top plate to an edge of the bottom plate and having a wire passage hole; a light source module fixed in place within the lamp base, such that light emitted from the light source module passes through the light-emitting hole; a plurality of transparent boards separably and vertically stacked on the lamp base and illuminated by the light source module, each said transparent board having a central hole; and an electrical wire module electrically connected to the light source module and passing through the wire passage hole to electrically connect with an external power supply to thereby control brightness of the light source module.

Implementation of the present invention at least involves the following inventive steps:

1. quick and easy to manufacture and assemble a lamp structure, and conducive to cost reduction;

2. easy to deliver the lamp structure, and fit to change a damaged part of the lamp structure only rather than discard the lamp structure in whole; and 3. variable in the shape of the lamp structure, and flexible in the light permeability and color of the lamp structure.

To enable persons skilled in the art to understand the technical solution disclosed in the present invention and implement it accordingly and enable persons skilled in the art to understand the objectives and advantages of the present invention easily according to the disclosures contained in the specification, claims, and drawings of the present invention, the features and advantages of the present invention are described in detail hereunder with reference to the embodiments of the present invention.

DETAILED DESCRIPTION OF THE INVENTION

Figure 1:
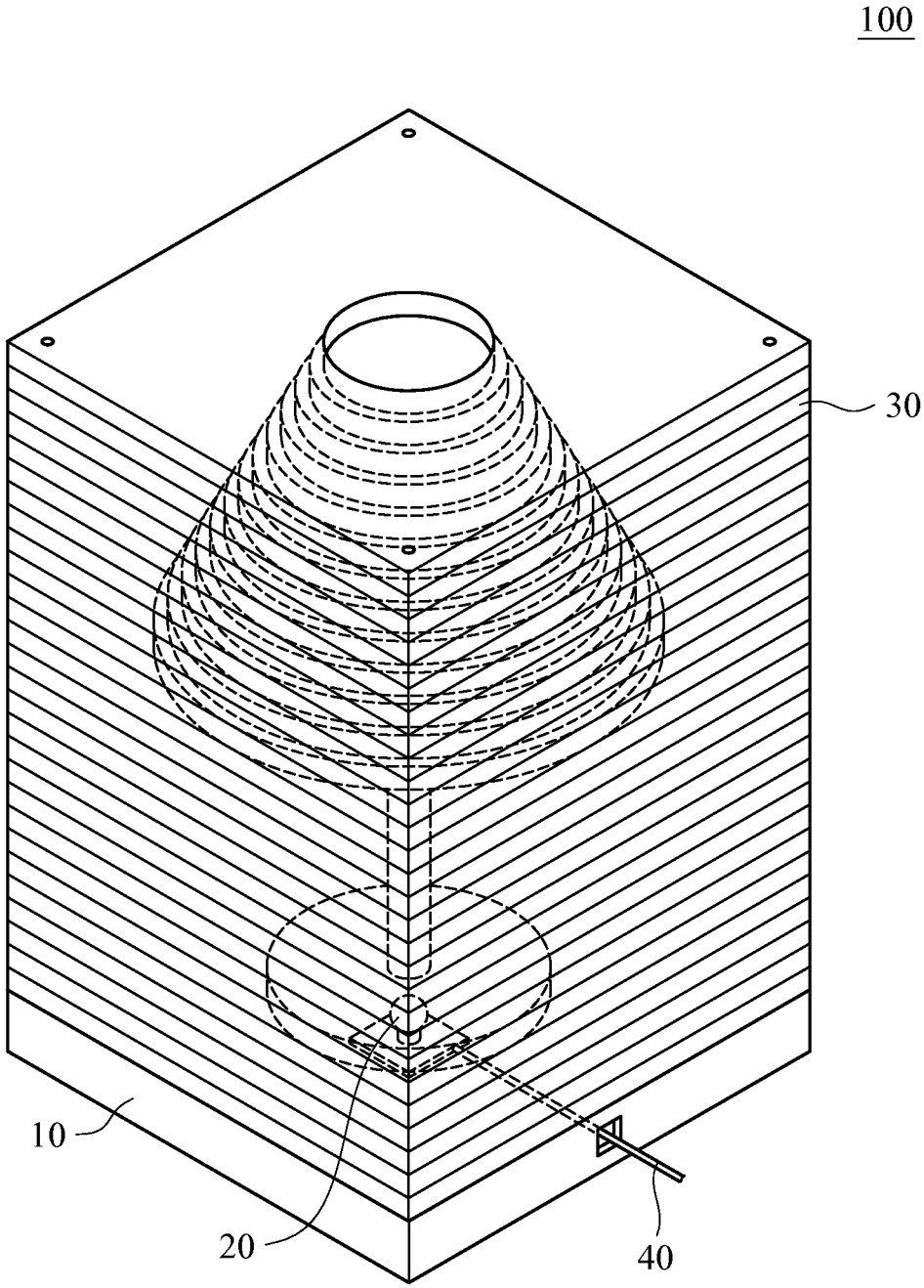
FIG. 1 is a perspective view of a lamp structure with stacked transparent boards according to an embodiment of the present invention.

Referring to FIG. 1, in this embodiment, a lamp structure 100 with stacked transparent boards comprises a lamp base 10, a light source module 20, a plurality of transparent boards 30, and an electrical wire module 40.

Figure 2:
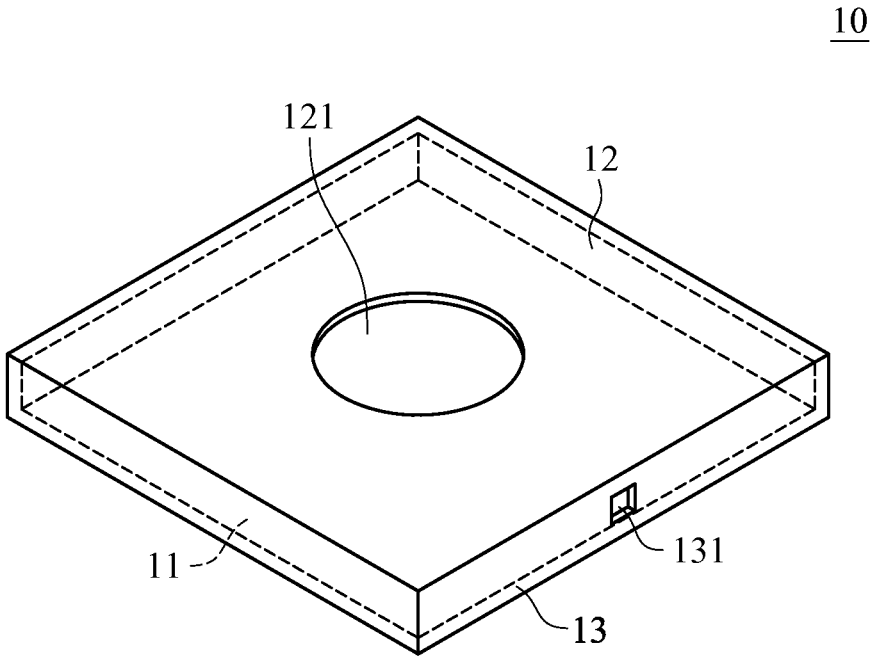
FIG. 2 is a perspective view of a lamp base according to an embodiment of the present invention.

Referring to FIG. 2, the lamp base 10 comprises a bottom plate 11, a top plate 12, and a side plate 13. The bottom plate 11 is a plate of the same dimensions as the transparent boards 30. Alternatively, the bottom plate 11 is a plate of larger or smaller dimensions than the transparent boards 30. The top plate 12 and the bottom plate 11 are opposite to each other and each have a centrally-disposed light-emitting hole 121. The side plate 13 extends from the edge of the top plate 12 to the edge of the bottom plate 11, such that the bottom plate 11, the top plate 12, and the side plate 13 together define a hollow core of the lamp base 10. A wire passage hole 131 is disposed at a lateral side of the side plate 13, such that the inside of the lamp base 10 is in communication with the outside of the lamp base 10. via the wire passage hole 131.

Figure 3:
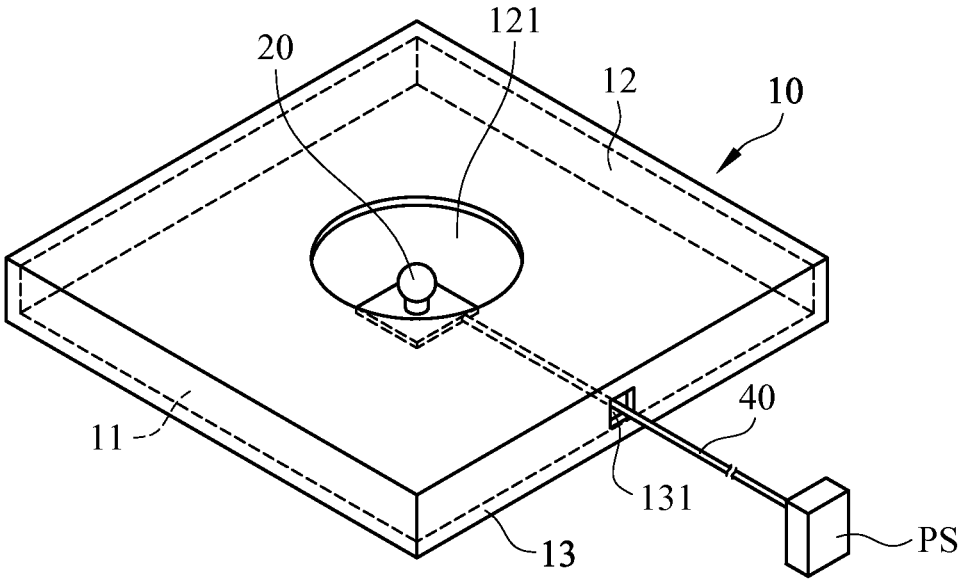
FIG. 3 is a schematic perspective view of the lamp base, a light source module, an electrical wire module, and an external power supply according to an embodiment of the present invention.

Referring to FIG. 3, the light source module 20 is fixed in place within the lamp base 10, such that light emitted from the light source module 20 passes through the light-emitting hole 121. A light-emitting diode (LED), which is energy-efficient, scorch-proof, and long in service life, functions as the light source of the light source module 20 to thereby achieve energy saving and dispense with the need to change the light source frequently. Furthermore, diverse choices of the color of the light source module 20 are not only available but also conducive to displaying the desirable shape of the lamp structure 100 with the stacked transparent boards 30.

Referring to FIG. 3, the electrical wire module 40 is not only electrically connected to the light source module 20, but also passes through the wire passage hole 131 on the side plate 13 to electrically connect with an external power supply PS. The electrical wire module 40 not only supplies power to the light source module 20, but also turns on/off the light source module 20 or controls the brightness of the light source module 20 to thereby adjust the brightness thereof.

Figure 4:
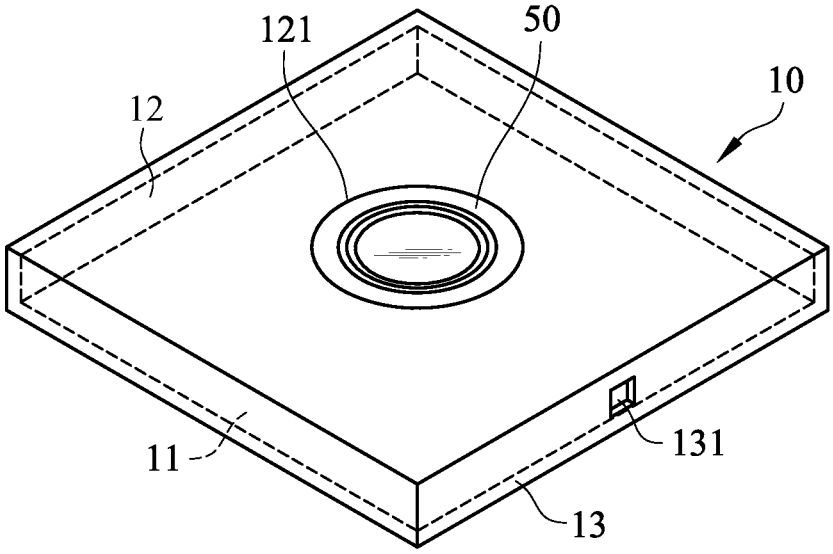
FIG. 4 is a schematic perspective view of the lamp base with a transparent plate which covers a light-emitting hole according to an embodiment of the present invention.

Referring to FIG. 4, the light-emitting hole 121 of the top plate 12 is further covered with a transparent plate 50. The transparent plate 50 is of the same size as the light-emitting hole 121. The transparent plate 50 not only shields the light-emitting hole 121 and thus prevents intrusion of foreign bodies into the lamp base 10, but also comes in different colors as needed to thereby enhance the flexibility of design of the lamp structure 100.

Figure 5:
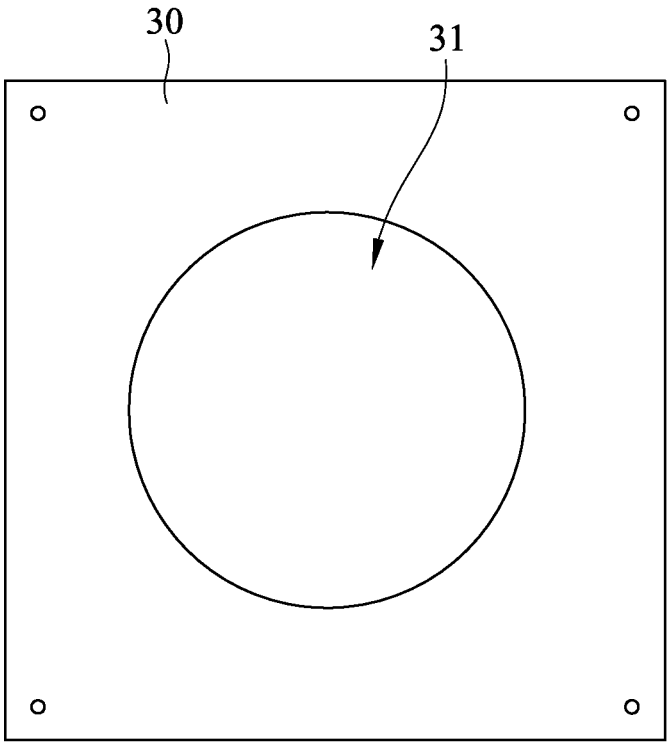
FIG. 5 is a top view of a transparent board according to an embodiment of the present invention.
Figure 6A:
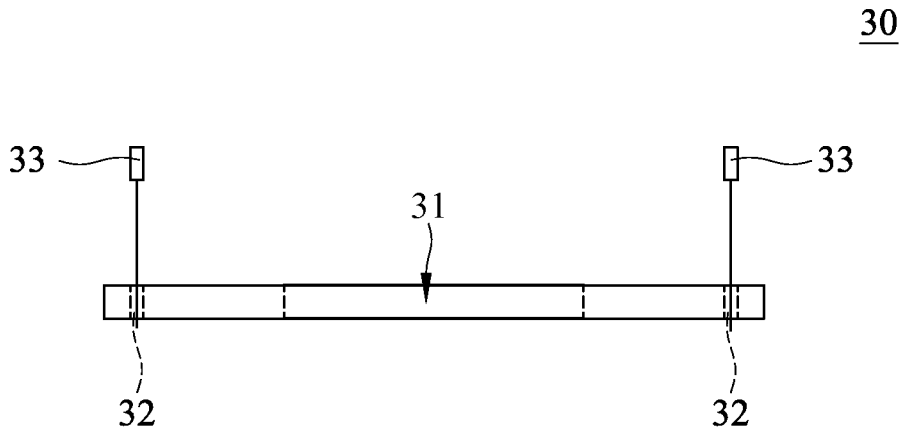
FIG. 6A is a lateral view of the transparent board, a central hole, and apertures according to an embodiment of the present invention.
Figure 6B:
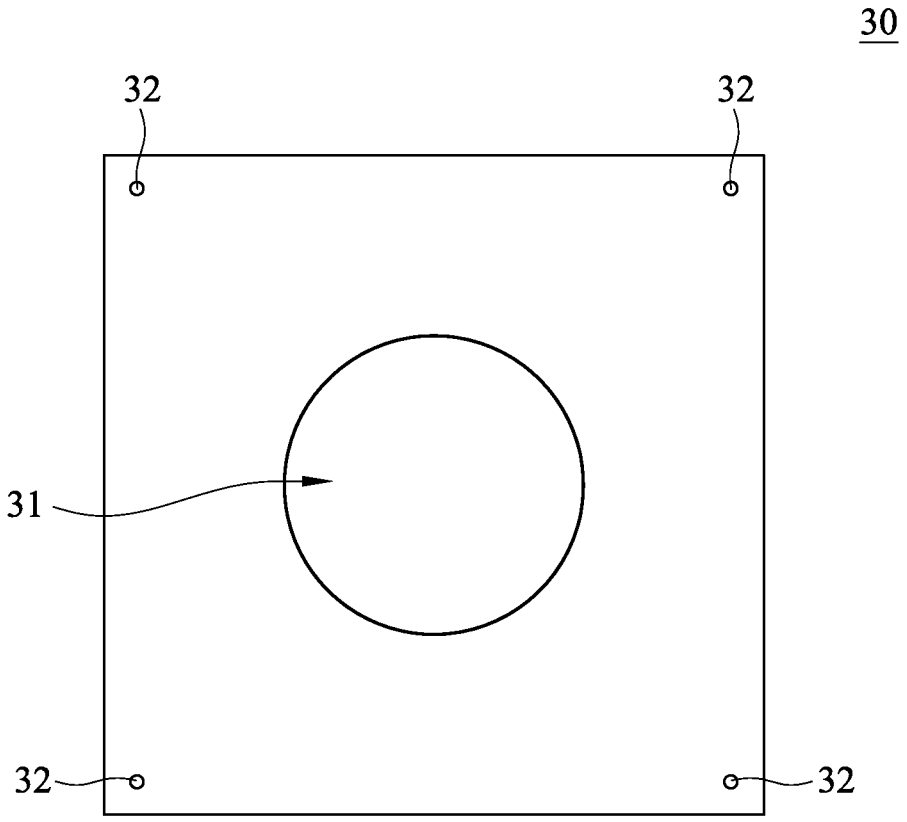
FIG. 6B is a top view of the transparent board, the central hole, and the apertures according to an embodiment of the present invention.
Figure 7:
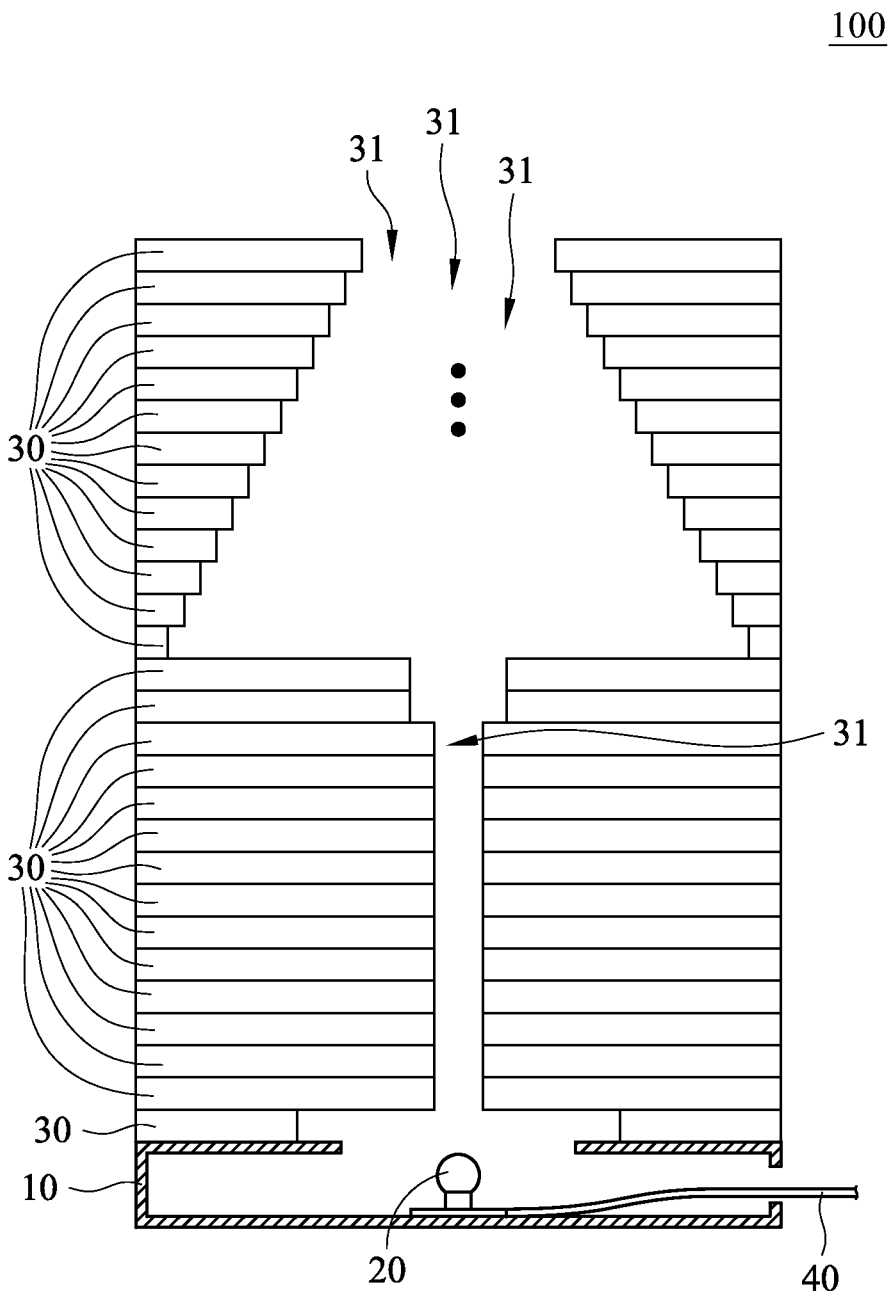
FIG. 7 is a lateral cross-sectional view of the lamp structure with stacked transparent boards according to an embodiment of the present invention.

Referring to FIG. 5 through FIG. 7, the transparent boards 30 are vertically stacked on the lamp base 10 and illuminated by the light source module 20. The transparent boards 30 each have a central hole 31. Light emitted from the light source module 20 passes through the light-emitting hole 121 before it reaches each of the transparent boards 30 and each of the central holes 31. The dimensions and size of each of the transparent boards 30 or the size of each of the central holes 31 are subjected to changes as needed. The transparent boards 30 can be made of acrylate.

Referring to FIG. 5 through FIG. 6B, the transparent boards 30 each further comprise at least two apertures 32, wherein none of the apertures 32 is in contact with the central holes 31. All the apertures 32 of each of the transparent boards 30 correspond in position to each other. The apertures 32 are each filled with a magnetic substance 33, such that any two adjacent ones of the transparent boards 30 can be separably stacked and sticked to each other by means of the magnetic substance 33 inside the apertures 32.

Referring to FIG. 5 through FIG. 7, to achieve the visual effect of light penetration, each of the central holes 31 of the transparent boards 30 is round (shown), elliptical (not shown), or polygonal (not shown). The round central holes 31 each preferably manifest symmetry. The central holes 31 of the transparent boards 30 are of equal or unequal size. Alternatively, the central holes 31 of the transparent boards 30 are of equal or unequal size in part. Hence, the light penetrates the transparent boards 30 to form various light penetration patterns as needed. In the embodiment shown in FIG. 7, the light penetration pattern looks like a desk lamp. Therefore, users and designers can design different light penetration patterns as needed.

Referring to FIG. 1 and FIG. 7, the lamp structure 100 equipped with the stacked transparent boards 30 according to an embodiment of the present invention is characterized in that: the central hole 31 of the plurality of stacked transparent boards 30 are stacked to form a light penetration pattern which looks like a desk lamp; and, when illuminated with the light source module 20, the desk lamp-like light penetration pattern appears in the manner shown in FIG. 1. Users and designers can design the transparent boards 30 of different shape and/or size, and/or design the central holes 31 of different shape and/or size, such that upon completion of the aforesaid stacking process the shape of the light penetration pattern is variable. Furthermore, the light penetration pattern can be designed in a manner that the axis of the light penetration pattern overlaps the axis of the transparent boards 30 to thereby bring about desirable symmetry.

Figure 8:
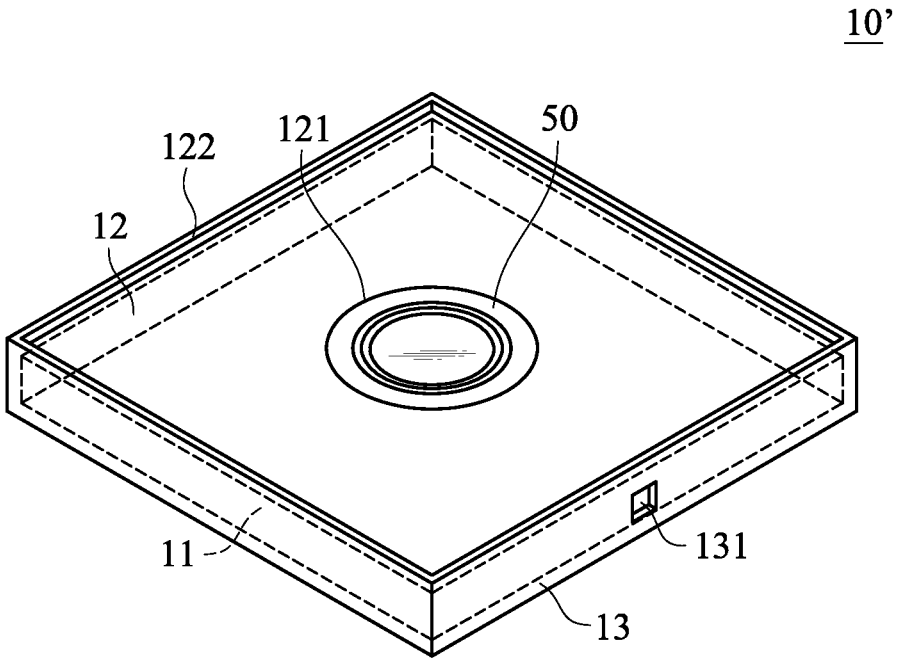
FIG. 8 is a perspective view of another lamp base according to an embodiment of the present invention.
Figure 10:
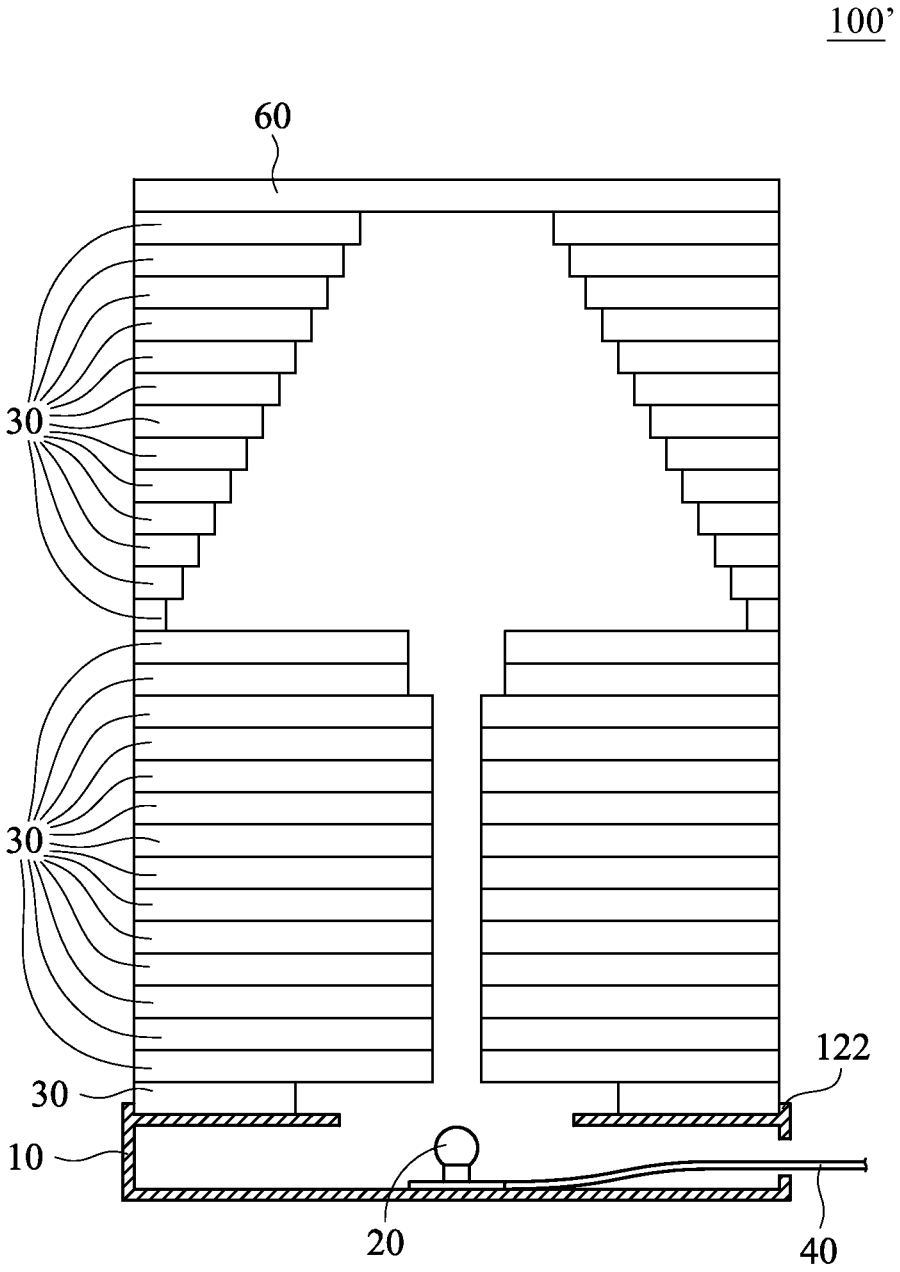
FIG. 10 is a lateral cross-sectional view of another lamp structure with stacked transparent boards according to an embodiment of the present invention.

Referring to FIG. 8 and FIG. 10, another lamp base 10' in an embodiment of the present invention is characterized in that: a flange 122 is formed at the periphery of the top plate 12; the lowest one of the transparent boards 30 is engaged with the flange 122 from inside; and the other transparent boards 30 are stacked on the lowest one of the transparent boards 30. Hence, the transparent boards 30 can be engaged with the flange 122 from inside and thus are unlikely to fall off.

Figure 9A:
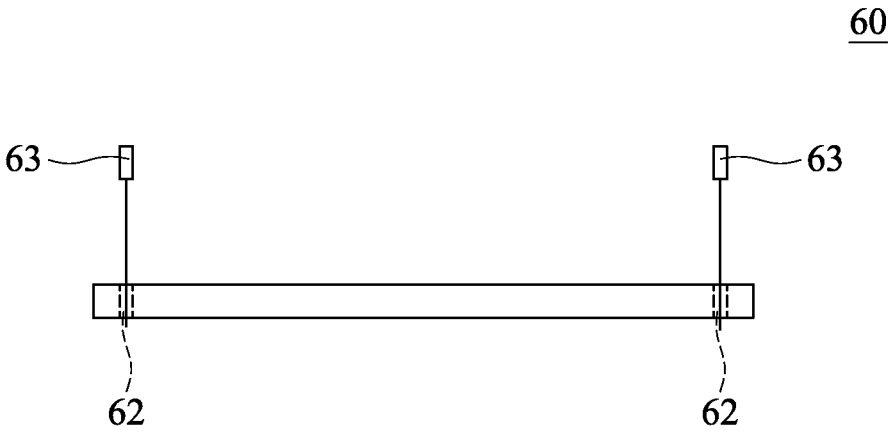
FIG. 9A is a lateral view of a lid according to an embodiment of the present invention.
Figure 9B:
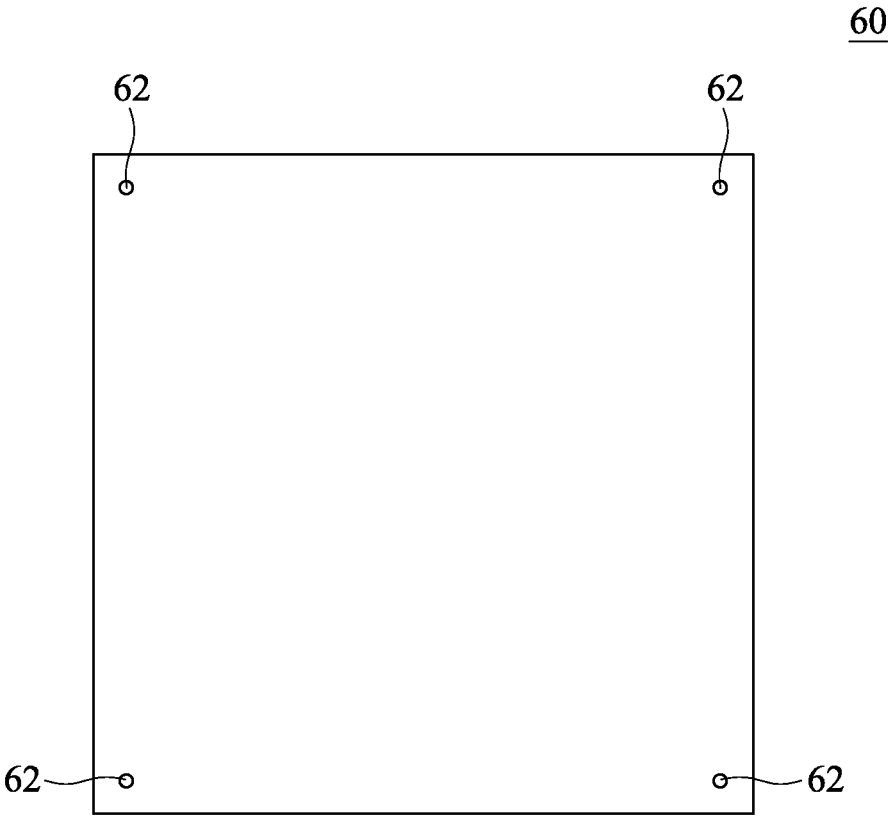
FIG. 9B is a top view of the lid according to an embodiment of the present invention.

Referring to FIG. 9A, FIG. 9B, and FIG. 10, the lamp structure in the embodiment of the present invention further comprises a lid 60 for covering the uppermost one of the transparent boards 30. The lid 60 is a transparent lid 60 made of acrylate or glass. The lid 60 is made of the same material as the transparent boards 30 and/or is of the same size as the transparent boards 30 to thereby enhance the consistency of the lamp structure 100' in its entirety. The lid 60 has a plurality of apertures 62. The apertures 62 of the lid 60 correspond in position to the apertures 32 of the uppermost one of the transparent boards 30, respectively. The apertures 62 of the lid 60 are also filled with a magnetic substance 63. Hence, the magnetic substances 33, 63 in the apertures 32, 62 enable the lid 60 to be separably superimposed on the uppermost one of the transparent boards 30.

Referring to FIG. 10, there is shown a lateral cross-sectional view of another lamp structure 100' with the stacked transparent boards 30 according to an embodiment of the present invention. The difference between the lamp structure 100' shown in FIG. 10 and the lamp structure 100 shown in FIG. 1 and FIG. 7 is as follows: the uppermost one of the transparent boards 30 of the lamp structure 100' shown in FIG. 10 is covered with the lid 60, and the lid 60 prevents intrusion of foreign bodies and water droplets into the lamp structure 100' with the stacked transparent boards 30.

Referring to FIG. 1, FIG. 5 through FIG. 7, FIG. 9A, FIG. 9B, and FIG. 10, the transparent boards 30 and the lid 60 are made of acrylate or glass, wherein acrylate has advantages, namely capable of being shaped, highly light permeable, easy to color, tough, durable, and cheap.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A lamp structure with stacked transparent boards, comprising:

a lamp base having a hollow core and comprising: a bottom plate; a top plate corresponding in position to the bottom plate and having a centrally-disposed light-emitting hole; and a side plate extending from an edge of the top plate to an edge of the bottom plate and having a wire passage hole;

a light source module fixed in place within the lamp base, such that light emitted from the light source module passes through the light-emitting hole;

a plurality of transparent boards separably and vertically stacked on the lamp base and illuminated by the light source module, each said transparent board having a central hole; and an electrical wire module electrically connected to the light source module and passing through the wire passage hole to electrically connect with an external power supply to thereby control brightness of the light source module.

2. The lamp structure of claim 1, further comprising a transparent plate for covering the light-emitting hole.

3. The lamp structure of claim 2, wherein the transparent plate is of same size as the light-emitting hole.

4. The lamp structure of claim 2, wherein a flange is formed at a periphery of the top plate, and a lowest one of the transparent boards is engaged with the flange from inside.

5. The lamp structure of claim 1, wherein a flange is formed at a periphery of the top plate, and a lowest one of the transparent boards is engaged with the flange from inside.

6. The lamp structure of claim 1, wherein the central hole is round, elliptical, or polygonal.

7. The lamp structure of claim 1, wherein the central holes of the transparent boards are of same or different size.

8. The lamp structure of claim 1, wherein the central holes of the transparent boards are of same size in part.

9. The lamp structure of claim 1, wherein the transparent boards each further comprise at least two apertures, the apertures not being in contact with the central holes, and the apertures of each of the transparent boards correspond in position to each other, the apertures each being filled with a magnetic substance, such that any two adjacent ones of the transparent boards can be separably stacked by means of the magnetic substance inside the apertures.

10. The lamp structure of claim 1, further comprising a lid for covering an uppermost one of the transparent boards.

11. The lamp structure of claim 10, wherein the transparent boards and the lid are made of acrylate.

12. The lamp structure of claim 1, further comprising a lid for covering an uppermost one of the transparent boards, wherein the transparent boards and the lid are made of acrylate.

* * * * *